United States Patent [19]

Rosenast

[11] 4,120,328

[45] Oct. 17, 1978

[54] SHUTTLE CONSTRUCTION

[75] Inventor: Louis Rosenast, Wald, Switzerland

[73] Assignee: Ruti Machinery Works Ltd., Ruti, Switzerland

[21] Appl. No.: 824,781

[22] Filed: Aug. 15, 1977

[30] Foreign Application Priority Data

Aug. 23, 1976 [CH] Switzerland ..... 10647/76

[51] Int. Cl.[2] ..... D03J 5/02

[52] U.S. Cl. ..... 139/196.1

[58] Field of Search ..... 139/196.1; 264/152, 264/257, 258

[56] References Cited

U.S. PATENT DOCUMENTS

| | | | |
|---|---|---|---|
| 3,089,522 | 5/1963 | Phelps | 139/196.1 |
| 3,215,762 | 11/1965 | Phelps | 139/196.1 |
| 3,425,463 | 2/1969 | Naul | 139/196.1 |

*Primary Examiner*—Henry S. Jaudon

*Attorney, Agent, or Firm*—Donald D. Denton

[57] ABSTRACT

A shuttle construction for weaving machines, having resin-impregnated fabric cover surrounding the center piece which forms walls of the shuttle that come together and overlap in the region of the tips of the shuttle.

3 Claims, 2 Drawing Figures

SHUTTLE CONSTRUCTION

BACKGROUND OF THE INVENTION

This invention relates to a shuttle for weaving machines, having a center piece and a covering of resin-impregnated fabric webs which surrounds the center pieces.

In known shuttles of this type the cover is either made of two parts, each part forming one wall of the shuttle, or the cover consists of a single part which is formed by fabric webs wound endlessly around the center piece.

In the case of shuttles having a bipartite cover, the fabric webs extend exclusively parallel to the longitudinal axis of the shuttle and are cut in the region of the reductions in cross-section towards the tips of the shuttle and are exposed at their ends. The exposed ends of the fabric webs represent a region of reduced strength. It has been found that this type of shuttle during operation tears relatively rapidly in the vicinity of the tip so that the shuttles become unusable.

By the wrapping of the center piece with endlessly wound fabric webs, the above disadvantage, at first sight, appears to be done away with; however, the following consideration shows that this is not so: As is known, in the production of shuttles provided with a covering of resin-impregnated fabric webs, the cover, while still not dry, is pressed against the center and thereby compressed to a fraction of its cross-section, for instance to about one-fourth thereof. It is not conceivable that a single-piece cover surrounding the center can withstand this reduction in cross-section without the fabric webs warping and twisting in irregular manner, with the possible formation of cavities and/or wrinkles in the region where the fabric web is wrapped around the tips of the shuttle. In this way, however, these shuttles are just as greatly weakened in the vicinity of their tips as are shuttles having the bipartite cover.

The closest prior art known to the applicant in connection with this application is the attached U.S. Pat. No. 3,089,522 to Phelps, the general disclosure of which is incorporated by reference in the specification of this application.

SUMMARY OF THE INVENTION

The present invention overcomes these disadvantages by producing a shuttle which has a center piece and a cover of resin-impregnated fabric webs surrounding said center, the tips of which do not represent regions of reduced strength.

This object is achieved in accordance with the present invention in the manner that the cover consists of two parts, each of which forms a wall of the shuttle, which overlap in the region of the tips of the shuttle, and when the resin-impregnated fabric is cured, there is produced tip ends that are not reduced in strength.

BRIEF DESCRIPTION OF THE DRAWINGS

The invention will be explained in further detail below on the basis of illustrative embodiments with reference to the drawings, in which.

DESCRIPTION OF PREFERRED EMBODIMENTS

Figure 1:
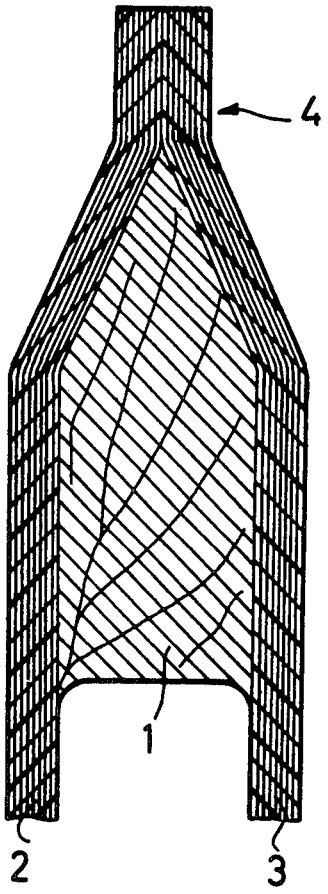
FIG. 1 is a diagrammatic view of a portion of the shuttle in cross-section showing tips arranged along the central axis of the shuttle.
Figure 2:
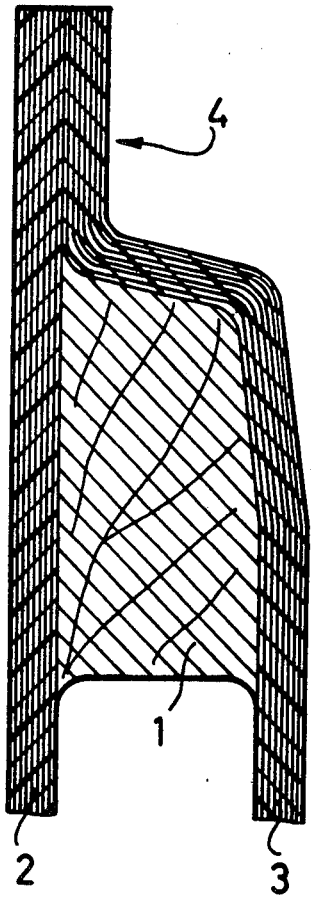
FIG. 2 is a diagrammatic view of a portion of the shuttle in cross-section showing tips arranged at the rear wall of the shuttle.

In accordance with the FIGS. 1 and 2, a center piece 1, which consists of wood but may of course be made of some other suitable material, is surrounded at the front and rear walls of the shuttle by separate cover parts 2, 3 of a resin-impregnated fabric web, said cover parts having inner and outer surfaces. The two cover parts 2, 3 extend in the longitudinal direction of the shuttle in the region of the shuttle tips 4 beyond the center piece 1 and overlap each other along a portion of their inner surfaces. The two cover parts 2, 3 are bonded together in the region of their overlap to form the oppositely positioned tips 4 as shown in FIGS. 1 and 2 in one end of the shuttle.

It will be appreciated that many fabric materials may be used that, when impregnated with a resin, will form a unitary structure and can at the tips 4 be bonded to each other. Also, any resin that is capable of forming a strong bond may be used so that, when the resin is cured or dried, cover parts 2 and 3 will form a good surface bonding with each other to form the resin-impregnated fabric shuttle ends 4.

It will be appreciated further that the outlined portions of the shuttle shown in FIGS. 1 and 2 are representative of the outline of a standard shuttle and whose relative size and shape and function are well known to one skilled in the art, a shuttle being used extensively in the field of weaving on weaving machines.

Also, as is shown in the drawings, the cover can be formed from a plurality of layers of fabrics resin-impregnated to build up a desired wall thickness having strength and durability.

What is claimed is:

1. Shuttle construction for a weaving machine having a center piece and a cover formed from resin-impregnated fabric webs surrounding the center piece, characterized by the fact that the cover consists of two parts each having inner and outer surfaces, each part extending in the longitudinal direction and forming a wall of the shuttle, and which parts come together and overlie each other along a portion of their inner surfaces to form an overlap in the region of the tip of the shuttle.

2. Shuttle construction for a weaving machine having a center piece and a cover formed from resin-impregnated fabric webs surrounding the center piece, characterized by the fact that the cover consists of two parts, each of which forms a wall of the shuttle and which come together and overlap each other in the region of the tips of the shuttle, said two cover parts extending parallel to the longitudinal axis of the shuttle in their overlap region.

3. The shuttle construction according to claim 2 in which the two cover parts are bonded to each other in their region of overlap.

* * * * *